US006713699B2

(12) United States Patent
Yoneyama

(10) Patent No.: US 6,713,699 B2
(45) Date of Patent: Mar. 30, 2004

(54) KEY SWITCH STABILIZER MECHANISM

(75) Inventor: Masayuki Yoneyama, Fujisawa (JP)

(73) Assignee: Minebea Co., Ltd., Nagano-Ken (JP)

( * ) Notice: Subject to any disclaimer, the term of this patent is extended or adjusted under 35 U.S.C. 154(b) by 0 days.

(21) Appl. No.: 10/388,255

(22) Filed: Mar. 13, 2003

(65) Prior Publication Data

US 2003/0209417 A1 Nov. 13, 2003

(30) Foreign Application Priority Data

Mar. 25, 2002 (JP) ..... 2002-084061

(51) Int. Cl.[7] ..... H01H 13/70
(52) U.S. Cl. ..... 200/344
(58) Field of Search ..... 200/5 A, 517, 200/344, 345; 400/490, 491, 491.2, 495, 495.1, 496

(56) References Cited

U.S. PATENT DOCUMENTS

| | | | | | |
|---|---|---|---|---|---|
| 4,368,414 | A | | 1/1983 | Watanabe et al. | 318/696 |
| 4,392,037 | A | * | 7/1983 | Fleming | 200/344 |
| 4,468,145 | A | * | 8/1984 | Denley | 400/496 |
| 4,562,393 | A | | 12/1985 | Loyzim et al. | 318/599 |
| 4,670,833 | A | | 6/1987 | Sachs | 363/132 |
| 4,710,686 | A | | 12/1987 | Guzik | 318/293 |
| 4,771,146 | A | * | 9/1988 | Suzuki et al. | 200/344 |
| 4,902,862 | A | * | 2/1990 | Oelsch et al. | 200/344 |
| 5,493,487 | A | | 2/1996 | Close et al. | 363/132 |
| 5,600,216 | A | | 2/1997 | Karwath et al. | 318/291 |
| 5,784,270 | A | | 7/1998 | Permuy | 363/132 |
| 5,823,325 | A | * | 10/1998 | Lin | 200/344 |
| 5,844,386 | A | | 12/1998 | Matsuoka et al. | 318/293 |
| 5,941,373 | A | * | 8/1999 | Cheng | 200/344 |
| 6,056,459 | A | | 5/2000 | Tsai | 200/344 |
| 6,100,482 | A | * | 8/2000 | Koma et al. | 200/344 |
| 6,288,507 | B1 | | 9/2001 | Makino et al. | 318/293 |

* cited by examiner

*Primary Examiner*—Michael A. Friedhofer
(74) *Attorney, Agent, or Firm*—Schulte, Roth & Zabel LLP; Joel E. Lutzker

(57) ABSTRACT

A key switch stabilizer mechanism having a first approximately C-shaped stabilizer wire which is connected to both a key top and a base plate, and is further supported so as to be able to turn with respect to the key top; and a second stabilizer wire having a flat portion connected to the base plate, a bent portion, and another flat portion connected to the key top. Therefore, touching even very lightly any part of the key top surface, in particular the top end peripheral edge, allows a pushing pressure to be imparted to the first and second wires arrayed within the key top, by means of which a membrane push mechanism operates. When pressure on the key top is released, the first and second stabilizer wires follow the reaction force from the membrane switch push mechanism and rise, such that the membrane switch can be operated.

9 Claims, 6 Drawing Sheets

KEY SWITCH STABILIZER MECHANISM

CROSS-REFERENCE TO RELATED APPLICATIONS

This application claims all rights of priority to Japanese Patent Application No. 2002-084061 filed on Mar. 25, 2002, (pending).

BACKGROUND OF THE INVENTION

The present invention relates to a keyboard key switch used in a keyboard in which multiple keys are arrayed as a computer input device. More particularly, the invention relates to a stabilizer mechanism in a mouse key or other key switch.

DESCRIPTION OF THE RELATED ART

In graphic display devices, mouse or trackball pointing devices are generally positioned as separate items from the keyboard input device, but in such cases a dedicated space is required for the pointing device, thus increasing the overall graphic display device installation surface area. Recently the use of portable computers such as notebook personal computers has been spreading, with mouses, trackballs, touchpads, joysticks, pointing sticks, etc. being built into keyboard devices.

Many of the key switches used in notebook computers and mouses may be given special shapes. For instance, a pair of key tops arrayed to the left and right on the near side of assembly 2 shown in FIG. 1, have a protruding end projecting in a round form upward from the top of the two left and right ends.

In contrast to key tops with this type of shape, in conventional key switches such as Patent No. JP 2001-014083, a pantograph-type switch pushing mechanism is generally positioned at the center, with an X-shaped part of the pantograph mechanism serving as a stabilizer.

Further, when the switch pushing mechanism alone is insufficient, a first approximately C-shaped stabilizer wire is arrayed along the inner perimeter edge of the keyboard. The stabilizer wire is formed with a hinge mechanism such that if one portion of the key top is depressed, other parts of the key top will be depressed at the same level. However, when the ends of these key tops are pushed, and especially when the upper ends of key tops not reached by the C-shaped wire are pushed, contact may not occur due to insufficient depression of the center portion of the key.

Also, notebook computer users touch keys very quickly with a finger touch, and expect normal operation wherever they hit the key top, that is, even if they have only slightly pushed on the key top edge. A stabilizer mechanism is therefore sought so that large key tops such as mouse keys or odd-shaped key tops will operate smoothly.

BRIEF SUMMARY

In light of the above, the present invention seeks to provide a stabilizer mechanism that will solve the above-mentioned problems, and which will be easily attached and of a thin-form structure, and with which a key switch will reliably operate.

In order to achieve the above goal, the present invention has a structure as described in the claims. In the key switch stabilizer mechanism of the present invention a membrane sheet having a contact circuit is arrayed between a base plate and a mounting frame, and equipped with a membrane switch push pressure device which causes the contact circuit contact in the mounting frame to go on and off.

The invention is characterized by comprising a first approximately C-shaped stabilizer wire which is connected to both a key top and a base plate, and is further supported so as to be able to turn with respect to the key top; and a second stabilizer wire having a flat portion connected to the base plate, a bent portion, and another flat portion connected to the key top.

According to this constitution, the first and second stabilizer wires are arrayed on the inner peripheral edge of the key top. Responding to the reaction force of the membrane switch push mechanism, the first stabilizer wire rises upward, supported by the bent feet at both ends of the first stabilizer wire, thus pushing the key top into parallel. At the same time, the protruding edge at the top of the key top is supported by the second stabilizer wire. For this reason, when the key top edge is lightly pushed, the second stabilizer maintains its elasticity and distorts, using the base plate protruding seat, and the fitting edge portion housed within the key top also sinks down, such that the membrane switch push mechanism is pushed. The result is that the membrane switch can be operated.

Therefore with the characteristics of the present invention, touching even very lightly any part of the key top surface, in particular the top end peripheral edge, allows a pushing pressure to be imparted to the first and second wires arrayed within the key top, by means of which a membrane push mechanism operates. When pressure on the key top is released, the first and second stabilizer wires follow the reaction force from the membrane switch push mechanism and rise, opening the switch.

In one embodiment of the present invention, the bent end feet portion of the first stabilizer wire form support points which fit onto the mounting frame fitting points. The wire follows the membrane switch push mechanism reaction force and rises upward, thus maintaining key top flatness. The second stabilizer wire is constituted so as to have a spring force which resists the offset push force against the key top protruding end portion. By this means, it is possible to realize reliable on/off operation in a membrane switch.

Another embodiment is characterized in that the protruding end portion of the key top has an engaging piece which projects from the inside surface. This fitting piece forms a sliding engagement surface between the support portions protruding from the corresponding part of the frame. With this configuration, the key top protruding end portion depresses straight down without tilting, so the second stabilizer wire fitting end portion receives pushing force as a unit with the first stabilizer wire, such that the key switch push mechanism can be pressed without excessive effort.

Yet another embodiment of the present invention is characterized in that a keyboard key switch comprises a pair of mouse keys positioned to the left and right on a base plate; each mouse key has a membrane switch push mechanism built onto the top of the base plate; the first stabilizer wire is housed within the mouse key top, and one end of the second stabilizer wire is fit onto the surface of the attaching flange formed on the side of the base plate, while the other end of the second stabilizer wire is fit into the fitting portion of the key top. As a result, the extension portion of the second stabilizer wire is elongated and spring force can be preserved, and the stabilizer mechanism of the present invention takes full advantage of the mouse key operational performance.

BRIEF DESCRIPTION OF DRAWINGS

A full understanding of the invention can be gained from the following description of the preferred embodiments when read in conjunction with the accompanying drawings in which.

DETAILED DESCRIPTION

Figure 1:
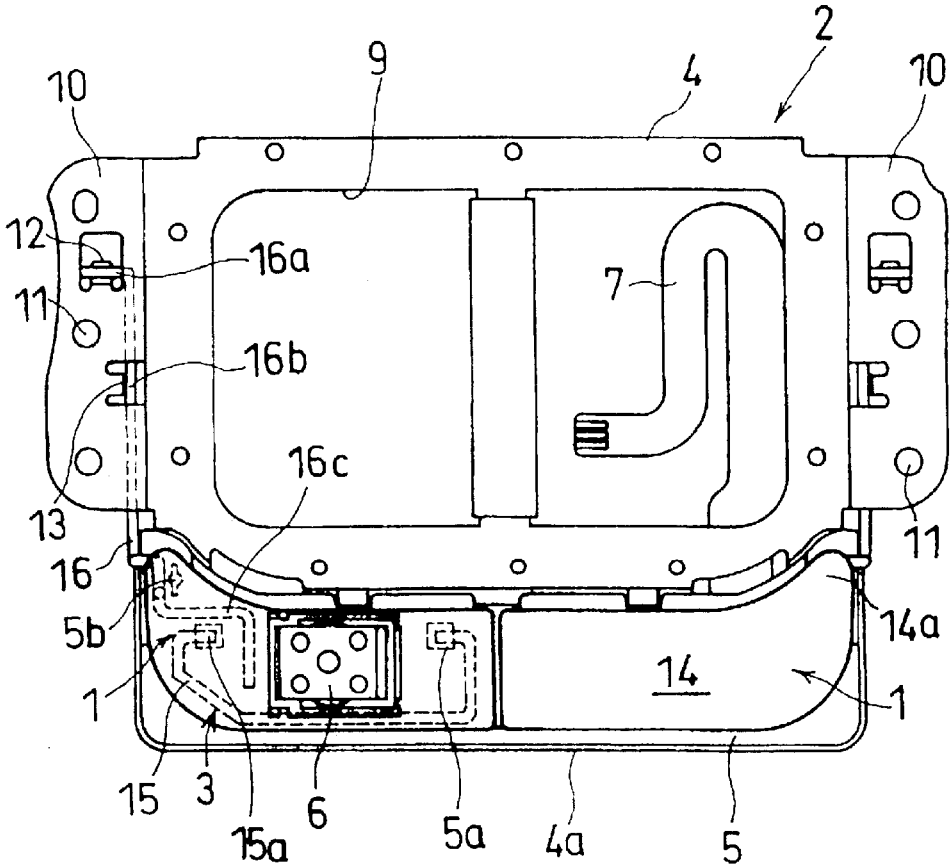
FIG. 1 is a summary plan view of an assembly for which the stabilizer of the present invention has been applied to a mouse key.
Figure 2:
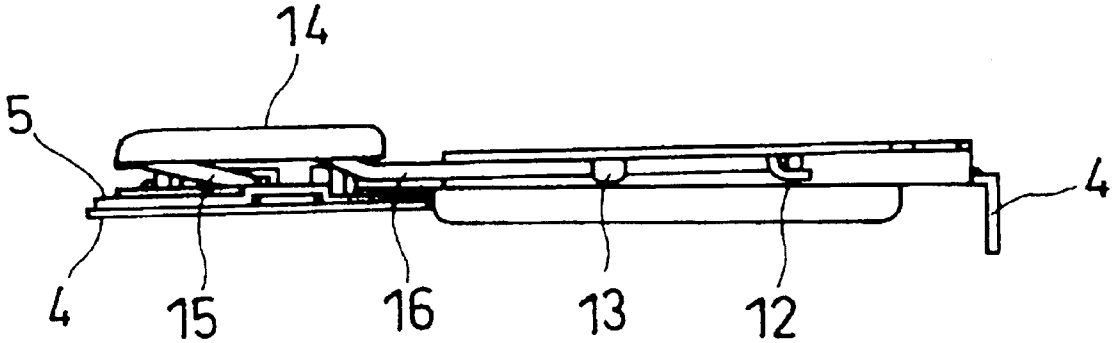
FIG. 2 is a right hand side view of FIG. 1.

We shall explain an embodiment of the present invention with reference to the attached figures. FIG. 1 depicts the overall structure of an assembly 2 of mouse keys 1, for attachment to the front edge of a keyboard (not shown in the figure). A key switch stabilizer mechanism 3 of the present invention is built into each mouse key 1. FIG. 2 is a side view of FIG. 1 seen from the right side.

Mouse keys 1 are mounted on a near side of assembly 2 in FIG. 1, and are symmetrically arranged to the left and right of push mechanism 6 which is heat bonded to front portion 4*a* on base plate 4.

Base plate 4 is preferably press-formed of aluminum plate or of surface-treated steel plate. Mounting frame 5 is preferably made of plastic, and has multiple projecting pins on the rear surface for heat bonding to base plate 4. Openings 5*c* into which are built multiple fitting projections 5*a*, 5*b* and push mechanism 6, are arrayed to the left and right (see FIG. 3(*b*)).

Mouse key 1 has left and right click functions, and therefore has key switch 8 (see FIG. 6) which forms a contact structure in membrane sheet 7 between base plate 4 and mounting frame 5. This key switch will be described below.

A left and a right opening 9 is provided on base plate 4 for positioning a pointer pad to the rear of mouse key 1. Horizontal flange portion 10 protruding from the top and bent over surrounds each opening 9. Each of these horizontal flange portions 10 has multiple holes 11 for the attachment of stabilizer mechanism 3, and two cut and bent portions. The cut and bent portions in this embodiment are protruding seat 12 and bent portion 13.

As shown in FIG. 1, mouse key 1 comprises key top 14 having a peripheral edge on which one top end portion 14*a* circularly projects, first stabilizer wire 15 arrayed along the inner perimeter edge of this top, second stabilizer wire 16 which fits onto protruding seat 12 and bent portion 13, and pantograph-shaped push mechanism 6.

First stabilizer wire 15 in FIG. 1 is arrayed along the backside of key top 14, such that it has a bent wire configuration in approximately a C shape. The center extension portion of first stabilizer wire 15 stretches along mouse key 1 key top 14 inside perimeter edge 14*b* (shown in FIG. 3*a*), and has bent foot portion 15*a* that faces the two wire end portions. The center extension portion of first stabilizer wire 15 is held in place by a pair of fitting portions 17 which project from the interior of key top 14. First stabilizer wire 15 can be turned around key top 14.

Figure 3:
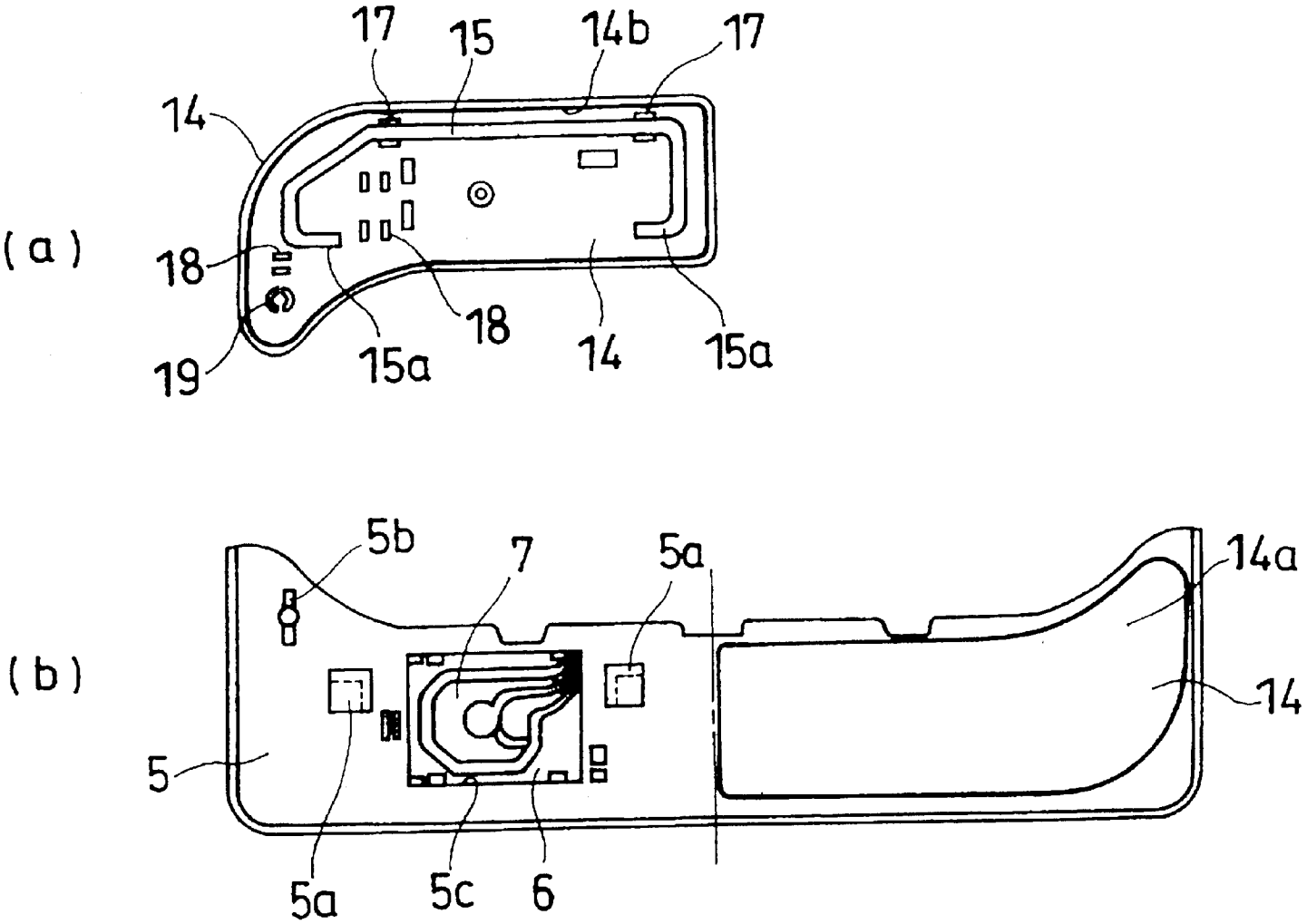
FIG. 3 represents portions of the mouse key portion of FIG. 1, in which (a) is a diagram of the back surface of a key top in which the first stabilizer wire is attached to the key top and (b) is a plan view of the mounting frame portion, shown with one of the key top portions removed.

When mouse key 1 is assembled, first stabilizer wire 15 engages by being fit into guide hole 5*a* in the fitting protuberance portion formed of the wire end portion bent foot 15*a* as the fitting portion of mounting frame 5 shown in FIG. 3(*b*). As a result, first stabilizer wire 15 rises upward, following the reaction force of mouse key 1 push mechanism 6, using bent foot 15*a* as a support point, thus maintaining the flatness of key top 14 with respect to mounting frame 5. As is clear by referring to FIG. 2, key top 14 floats parallel to mounting frame 5.

Figure 4:
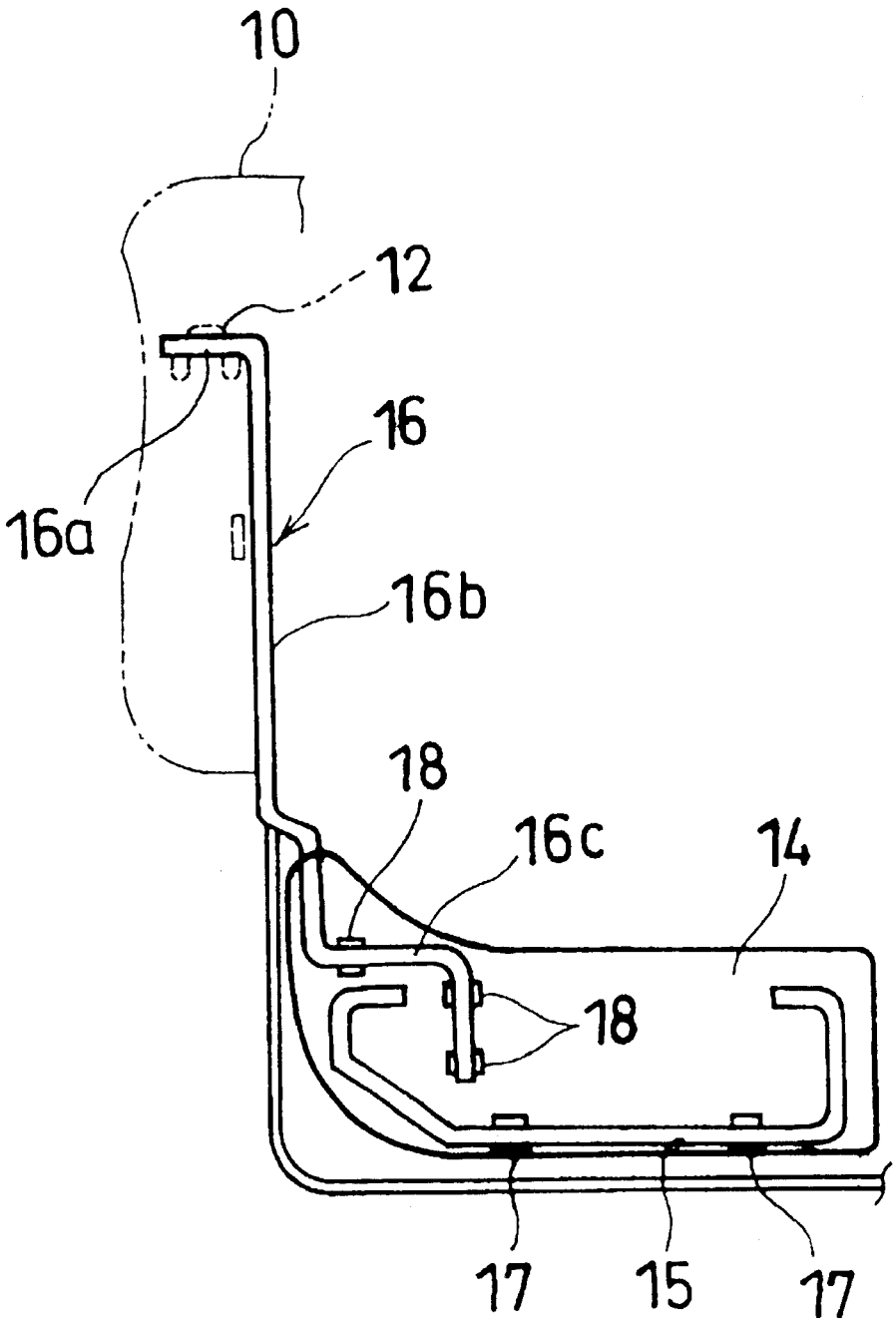
FIG. 4 is a diagram showing the configuration of the first and second stabilizer wire of the present invention.

FIG. 4 is a positional configuration diagram seen from above, showing the state in which first and second stabilizer wires 15 and 16 are built into mouse key 1 and base plate 4. As shown in FIGS. 1 and 4, second stabilizer wire 16 has bent end portion 16*a* supported by protruding seat 12 positioned on base plate 4 horizontal flange portion 10, extension portion 16*b* extending from this bent end portion, and fitting end portion 16*c* winds out from this extended portion and which fits into fitting portion 18 on the back of key top 14 and is housed within the back of key top 14.

Figure 5:
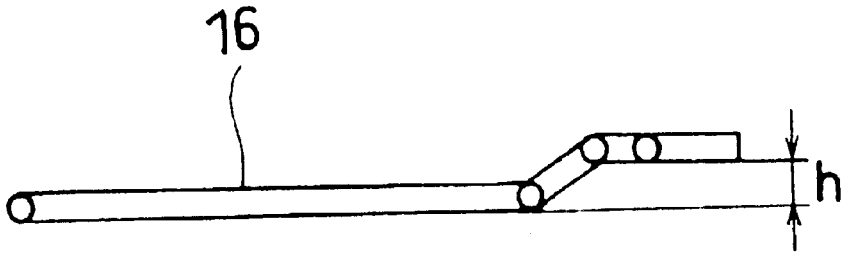
FIG. 5 is a diagram of the second stabilizer wire of the present invention, in which (a) is the side view thereof and (b) is a perspective view thereof.
Figure 5:
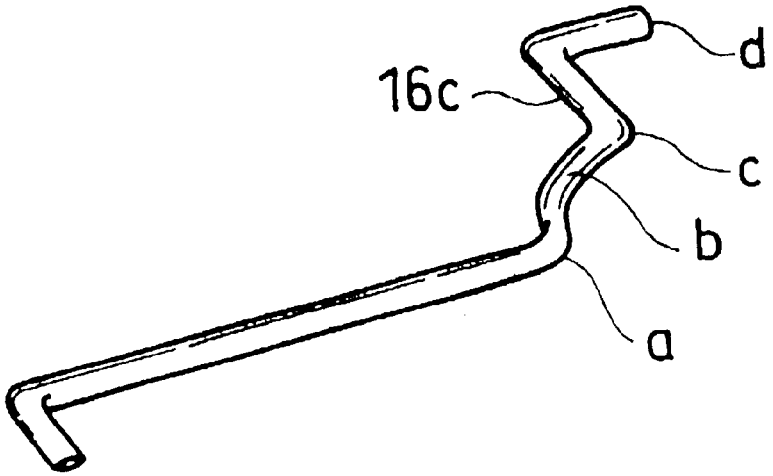

FIG. 5(*a*) is a view from the side of second stabilizer wire 16. FIG. 5(*b*) is a perspective view thereof. In FIG. 5(*a*), a very small step h is formed in second stabilizer wire 16 between bent end portion a and fitting edge portion c. The overall external shape of second stabilizer wire 16 is shown in FIG. 5(*b*). In order to form this small step h, second stabilizer wire 16 is bent inward from extension portion b winding point a. It is also tilted slightly upward and popping up so as to penetrate the back surface inner side of the key top from bending point b which contacts the peripheral bottom portion of key top 14. Therefore fitting edge portion 16*c*, which forms an L shape from bending point c to wire end d, has a step height h with respect to extension portion b and is press-fit into fitting portion 18 provided on the back side of key top 14 which rises up due to key switch push mechanism 6, so that a stroke determined by the degree of key top 14 depression can be obtained.

Accordingly, with the stabilizing mechanism of the present invention, as shown in FIGS. 3(*a*) and (*b*), in first stabilizer wire 15, bent end portion 15*a* forms a support point which fits into mounting frame 5 fitting portion. By following the reaction force of membrane switch push mechanism 6 and rising up, the flatness of key top 14 is maintained, while second stabilizer wire 16 has a spring force which opposes the offset pushing force against key top 14 protruding end portion 14*a*.

In a preferred embodiment of the present invention, engaging piece 19 which protrudes from inside is provided on key top 14 protruding end portion. This engaging piece 19 is formed from a pair of sleeves having a semicircular shape in its cross-section Engaging piece 19 forms a sliding engagement surface between the support portions protruding from corresponding positions on mounting frame 5, and also serves as a stopper which sticks out and touches the rear surface of mounting frame 5. As a result, key top 14 protruding end portion 14*a* will depress straight down even if subjected to an uneven touch in this area, and engaging piece 19 will impart a predetermined stroke, thus reliably operating key switch push mechanism 6. Further, the wire spring force is preserved without causing excessive pressing force on second stabilizer wire 16, due to the stopper function of engaging piece 19 provided with a sliding engagement surface.

Figure 6:
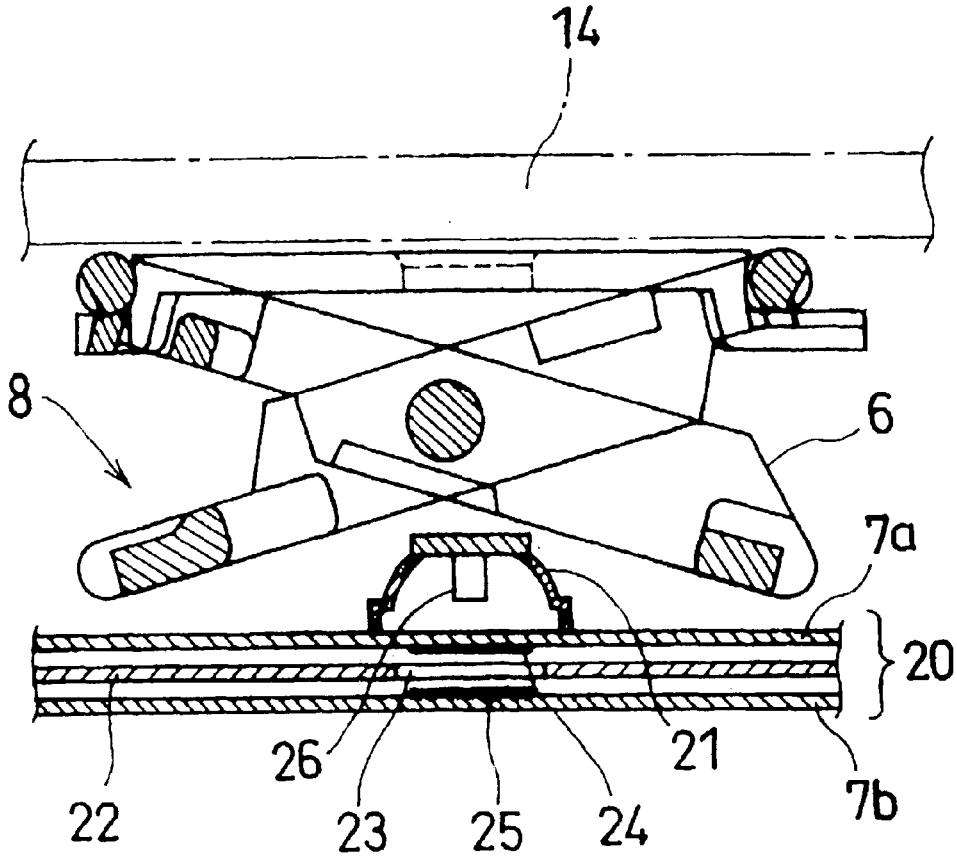
FIG. 6 is a summary sectional diagram showing the structure of a common key switch fitted with the stabilizer mechanism of the present invention.

As shown in FIG. 6, key switch 8 which forms mouse key 1 comprises, from the bottom, switch section 20, made up of membrane sheet 7 positioned on base plate 4 (not shown), push mechanism 6 assembled in an X shape and opening and closing in pantograph form, click rubber 21 made up of a bowl-shaped rubber elastic part, and key top 14.

Switch section 20 has a 3-layer structure: in the middle is spacer sheet 22, with membrane sheets 7*a* and 7*b* having contacts thereto above and below. By operation of push mechanism 6 which is built into mounting frame 5, contacts 24 and 25 of membrane sheets 7*a* and 7*b* which face spacer sheet 22, opening holes 23 are brought into on/off contact by the switch through the inside convex portion 26 of click rubber 21.

Below, as one example, the assembly steps for key switch stabilizer mechanism 3 of the present invention will be described. A 3-layer structured membrane sheet 7 is arrayed on the base plate; mounting frame 5 is affixed by hot bonding, and push mechanism 6 housing click rubber 21 is fit into openings on mounting frame 5. Second stabilizer wire 16 is assembled to base plate 4, and first stabilizer wire 15, which is made fit onto key top 14, is pressed into mounting frame 5 fitting hole 5*a*. By further pressing key top 14 from above at a specified position, second stabilizer wire 16 flat portion 16*c* is pressed into key top 14 fitting portion 18, and mouse key 1 is assembled onto base plate 4.

In mouse key 1, first stabilizer wire 15 surrounds the inside peripheral edge of key top 14; the tip of second stabilizer wire 16 flat portion 16*c* is positioned close to key switch push mechanism 6, and upper protruding end portion 14*a* on key top 14 is supported by second stabilizer wire 16 winding portion b and receives the key touch force. Therefore with even a slight touch force on protruding end portion 14*a,* second stabilizer wire 16 can operate and depress so that key switch push mechanism 6 is operated.

Several examples of the present invention stabilizer mechanism used in a keyboard mouse key, have been depicted as described above, but certainly the mechanism may be used in other common key switches, such as laptops.

As is clear from the explanation above, the key switch stabilizer mechanism of the present invention is such that due to the first and second stabilizer wires, the stabilizer mechanism operates reliably no matter what part of the key top perimeter is touched, and regardless of the weakness or strength of the touch force. Using this motion, a key switch push mechanism can be reliably operated. Also, the stabilizer mechanism of the present invention has a thin-form structure due to its use of 2 wires; reliability of the spring material is high and assembly is accomplished simply by fitting and pressing into a base plate and mounting frame, such that mounting is easy and workability is improved.

We claim:

1. A key switch stabilizer mechanism for a key switch having a key top and a base plate comprising:

a first approximately C-shaped stabilizer wire which is connected to said key top and said base plate so as to be movable along an inside of said key top and rotatable with respect to said key top; and a second stabilizer wire having a bent end supported by the base plate, a first straight portion connected to the base plate, a bent portion, and a second straight portion connected to the key top.

2. A key switch stabilizer mechanism according to claim 1, wherein said key switch further comprises a mounting frame and a membrane sheet having a contact circuit arrayed between the base plate and the mounting frame, said contact circuit having a contact point, and wherein said key switch is equipped with a membrane switch push device which causes the contact circuit contact point in the mounting frame to go on and off.

3. A key switch stabilizer mechanism according to claim 1, wherein said first stabilizer wire further comprises a bent foot portion, wherein said key switch further comprises a mounting frame having a fitting portion, and wherein the first stabilizer wire forms a support point where said bent foot portion fits into the mounting frame fitting portion.

4. A key switch stabilizer mechanism according to claim 3, wherein said key switch further comprises a membrane switch pushing mechanism and protruding end portion, wherein flatness of the key top is maintained by raising it up following the reaction force of the membrane switch pushing mechanism, and wherein the second stabilizer wire has a spring force which resists an offset push force with respect to the protruding end portion of the key top.

5. A key switch stabilizer mechanism according to claim 1, wherein said key switch further comprises a mounting frame having a support portion and wherein said key top further comprises a protruding end portion having a fitting portion extending from said protruding end portion towards said mounting frame and corresponding to said support portion, and wherein a sliding engaging surface is formed between said support portion and said fitting portion.

6. A key switch stabilizer mechanism according to claim 1, wherein a keyboard key switch further comprises a left and a right mouse key arrayed as a pair on the base plate, wherein each mouse keys has a membrane switch pushing mechanism attached to the base plate; wherein the first stabilizer wire is held inside the mouse key top; wherein an attachment flange is formed on a side of the base plate, and wherein one end of the second stabilizer wire engages a surface of the attachment flange, and the other end of the second stabilizer wire engages the key top.

7. A notebook computer including a keyboard having a plurality of key switches; at least one of said key switches comprising:

a key top;

a base plate; and a stabilizer mechanism, said stabilizer mechanism further comprising a first approximately C-shaped stabilizer wire which is connected to said key top and said base plate so as to be movable along an inside of said key top and rotatable with respect to said key top; and a second stabilizer wire having a bent end supported by the base plate, a first straight portion connected to the base plate, a bent portion, and a second straight portion connected to the key top.

8. A keyboard comprising:

a plurality of key switches;

at least one of said key switches having a key top;

a base plate; and a stabilizer mechanism, said stabilizer mechanism further comprising a first approximately C-shaped stabilizer wire which is connected to said key top and said base plate so as to be movable along an inside of said key top and rotatable with respect to said key top; and a second stabilizer wire having a bent end supported by the base plate, a first straight portion connected to the base plate, a bent portion, and a second straight portion connected to the key top.

9. A computer mouse comprising:

at least one key switch having a key top;

a base plate; and a stabilizer mechanism, said stabilizer mechanism further comprising a first approximately C-shaped stabilizer wire which is connected to said key top and said base plate so as to be movable along an inside of said key top and rotatable with respect to said key top; and a second stabilizer wire having a bent end supported by the base plate, a first straight portion connected to the base plate, a bent portion, and a second straight portion connected to the key top.

* * * * *